US005735358A

United States Patent [19]

Lyon

[11] Patent Number: 5,735,358

[45] Date of Patent: Apr. 7, 1998

[54] INDEXING PERCUSSIVE DRILLING BIT

[75] Inventor: Leland H. Lyon, Roanoke, Va.

[73] Assignee: Ingersoll-Rand Company, Woodcliff Lake, N.J.

[21] Appl. No.: 660,630

[22] Filed: Jun. 6, 1996

[51] Int. Cl.[6] ..... E21B 10/36

[52] U.S. Cl. ..... 175/96; 173/133; 175/296; 175/415

[58] Field of Search ..... 175/414, 415, 175/321, 296, 96; 173/133

[56] References Cited

U.S. PATENT DOCUMENTS

| | | | |
|---|---|---|---|
| 2,624,549 | 6/1953 | Wallace | 175/321 |
| 3,692,122 | 9/1972 | Curington | 175/296 X |
| 4,084,646 | 4/1978 | Kurt | 173/17 |
| 4,413,689 | 11/1983 | Hughes et al. | 175/409 |
| 4,505,343 | 3/1985 | Hughes et al. | 175/409 |
| 4,706,764 | 11/1987 | Hughes | 175/415 X |
| 4,729,439 | 3/1988 | Kurt | 175/96 |
| 4,836,306 | 6/1989 | Barrows | 175/321 |
| 4,862,976 | 9/1989 | Meek | 175/415 |
| 4,953,640 | 9/1990 | Kurt | 175/320 |
| 5,065,827 | 11/1991 | Meyers et al. | 175/414 |
| 5,145,016 | 9/1992 | Estes | 175/374 |
| 5,174,390 | 12/1992 | Kurt | 175/53 |
| 5,207,283 | 5/1993 | Lay | 175/296 |
| 5,407,022 | 4/1995 | Scott et al. | 175/374 |
| 5,453,401 | 7/1995 | Hedlund et al. | 175/296 |

*Primary Examiner*—Hoang C. Dang
*Attorney, Agent, or Firm*—John J. Selko

[57] ABSTRACT

A chuck and drill bit combination for insertion into a front end of a percussive, down the hole drill forming a part of a cluster drill assembly, for selectively engaging and disengaging the chuck and drill bit during drilling operations includes the bit and chuck each having splines and grooves adapted to overlap and engage each other in a first stop position and further adapted to disengage from each other in a second stop position, whereby the bit is restrained from rotational movement but capable of axial movement in the first stop position and capable of both axial and rotational movement in the second stop position, to provide automatic indexing of the bit so as to position the bit's gage drilling buttons in a preferred position outboard of the drill centerline, to maintain maximum borehole diameter.

5 Claims, 2 Drawing Sheets

INDEXING PERCUSSIVE DRILLING BIT

BACKGROUND OF THE INVENTION

This invention relates generally to percussive, down-the-hole drills and more particularly to a down-the-hole drill bit and chuck combination used in applications which employ a multiplicity of drills ganged together to form a cluster drill. Such drilling apparatus are described in Kurt U.S. Pat. Nos. 5,174,390 and Kurt 4,729,439.

A common problem with cluster drills using non-rotating drills is that ganged drills cut the gage of the hole with only one or two buttons on each individual drill. As a result, gage button density is not as great as desired and gage wear of the drilling apparatus occurs rapidly in medium to abrasive formations. To address the gage wear problem associated with fixed bits, rotating bits have been developed which sweep the periphery exposing all gage buttons on individual drills to the hole wall. Each bit rotates within its respective drill and thereby exposes, and cuts, the gage with as many buttons as is possible. However, a common problem with the rotating bit apparatus is that they require high torque mountings and are prone to radial and thrust bearing wear. The cost associated with providing rotary heads with adequate torque in addition to the service costs attached to replacing and servicing the rotary and axial bit bearings can be prohibitive.

The foregoing illustrates limitations known to exist in present cluster drill bit and chuck combinations. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a chuck and drill bit combination for insertion into a front end of a casing member of a percussive, down the hole drill for selectively engaging and disengaging said chuck and drill bit during drilling operations comprising: a chuck adapted for insertion into the casing member; a drill bit adapted for insertion into the chuck; means for retaining the drill bit within the chuck while permitting the bit to move axially between a first and second stop position; the bit and chuck each having splines and grooves adapted to overlap and engage each other in the first stop position and further adapted to disengage from each other in the second stop position, whereby the bit is restrained from rotational movement but capable of axial movement in the first stop position and capable of both axial and rotational movement in the second stop position; the bit having a head with an outer periphery containing a plurality of abrasion resistant gage buttons for maintaining maximum borehole diameter.

The foregoing and other aspects will become apparent from the following detailed description of the invention when considered in conjunction with the accompanying drawing figures.

BRIEF DESCRIPTION OF THE DRAWING FIGURES

Figure 3:
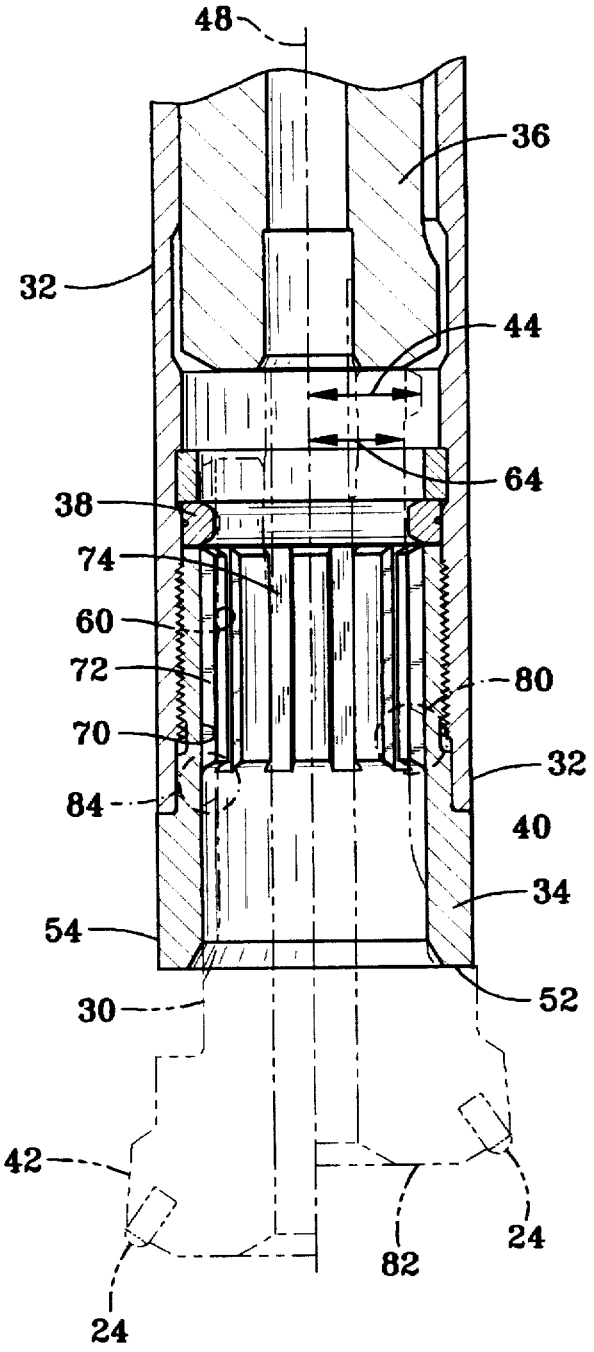
Figure 4:
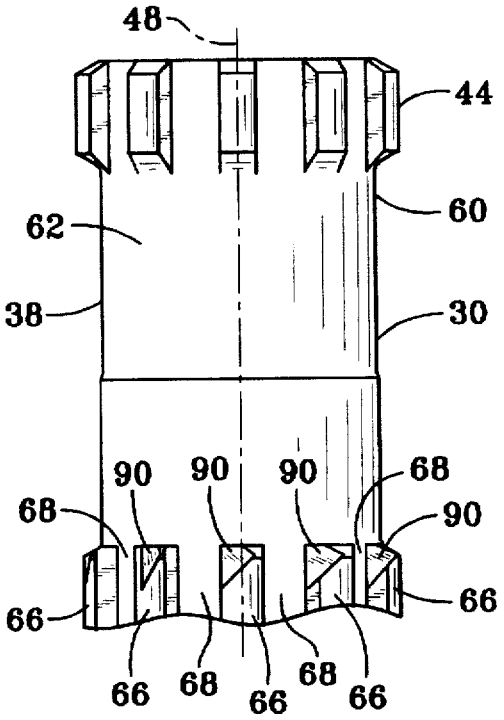

FIG. 3 is a longitudinal cross-sectional view of a front end of a drill of the invention, with a drill bit in phantom, the view to the left of the centerline showing the bit in a first stop position, and the view to the right of the centerline showing the bit in a second stop position; and FIG. 4 is a longitudinal view of parts of a drill bit of the invention, showing chamfered surfaces at the top of bit splines.

DETAILED DESCRIPTION

Figure 1:
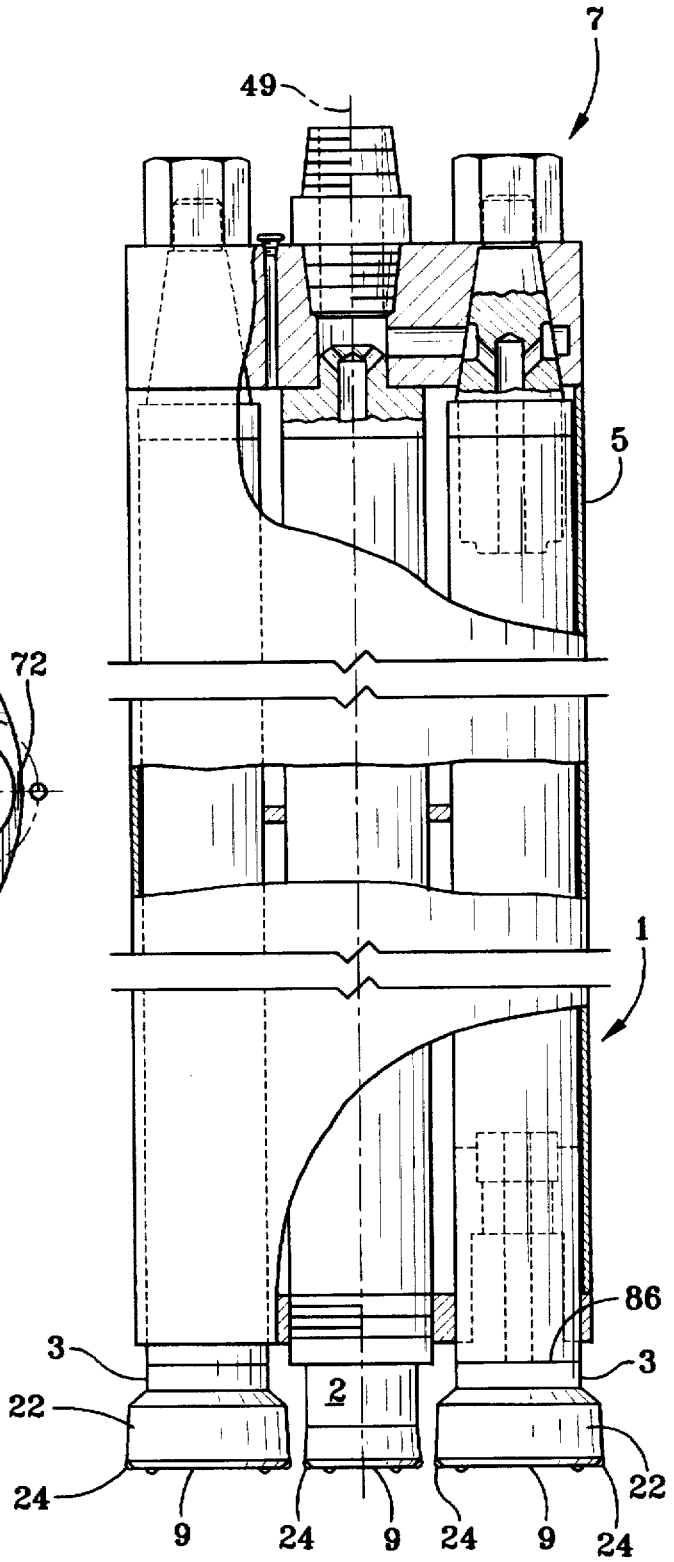
FIG. 1 is a longitudinal, partially cross-sectional view of a cluster drill according to the invention.

FIG. 1 is a longitudinal, partially cross-sectional view of a cluster drill according to the invention. The cluster drill 1 has a center percussion drill 2 surrounded by an assembly of a plurality of individual external percussion drills 2 and 3 in a cylindrical casing 5 having a top end 7 connected to a drill string (not shown), said casing 5 totally enclosing said percussive drills 3. As is well known, pressure fluid is supplied to operate each drill 2 and 3 individually.

Each individual drill 3 has a drill head 9 carrying a plurality of abrasive drill buttons. Arrayed in a circular fashion around an outer periphery 22 of drill head 9 are gage buttons 24, whose purpose is to contact the drill borehole (not shown) and maintain the maximum borehole diameter.

Now referring to FIGS. 3 and 4, there is shown an individual bit 30 inserted into a front end of a casing 32 of a conventional down-the-hole drill. Bit 30 is axially slidable within chuck 34 between a first and second stop position, as described hereinafter. As is well known, piston 36 reciprocates to strike bit 30 to advance the drill.

Bit 30 is held within casing 32 by means of split retaining ring 38. Bit 30 includes a shank portion 40, a head portion 42 at one end and a retaining shoulder portion 44 at the opposite end. Head portion 40 carries the gage buttons 24 as described hereinabove. Shank 38 terminates in its upper end in retaining shoulder 44 having a first diameter 46 with respect to drill centerline 48. Retaining shoulder 44 is adapted to contact split ring 38 to hold bit 30 in chuck 34, providing a first stop position. A bit drive shoulder 52 adjacent bit head 42 is adapted to seat against a front end 54 of chuck 34, when bit 30 is in contact with a borehole bottom, providing a second stop position.

Annular undercut groove 60 in shank portion 40 outer surface 62 adjacent retaining shoulder 44 has a second diameter 64 with respect to centerline 48, second diameter 64 being smaller than first diameter 46. Annular undercut 60 extends axially along shank 40 a distance to permit axial movement of bit 30 between first and second stop positions for a purpose to described hereinafter.

Bit shank portion 40 forms in its outer surface 62 a plurality of alternately spaced, axially extending bit splines 66 and grooves 68.

Chuck 34 has an inner circumferential surface 70 forming a plurality of alternately spaced, axially extending chuck splines 72 and grooves 74. Chuck 34 is adapted to thread into casing 32, as is well known.

As shown in FIG. 3 to the right of centerline 48, bit 30 is in the first stop position whereby splines 66 and grooves 68 of bit 30 overlap and engage splines 72 and grooves 74 of chuck 34, in overlap area encircled and numbered 80, whereby bit 30 is restrained from rotational movement but capable of axial movement. First stop position is the position assumed when the face 82 of bit 30 is in contact with the bottom of borehole (not shown), i.e. during the actual drilling phase of the drilling operation.

As shown in FIG. 3 to the left of centerline 48, bit 30 is in the second stop position, with the bit 30 dropped down to cause contact between split ring 38 and retaining shoulder 44, whereby splines 66 and grooves 68 of bit 30 are axially spaced from splines 72 and grooves 74 of chuck 34, leaving a gap of free space encircled and numbered 84 between the two sets of splines and grooves. In this juxtaposition, bit 30 is capable of both axial and rotational movement. Second stop position is the position assumed when the drill is raised out of contact from the borehole bottom (not shown) during the operation. When the drill is dropped back down into drilling position, splines 72 and grooves 74 of chuck 34 engage with splines 66 and grooves 68 of bit 30 to randomly index bit 30 to position gage bits 24 at a maximum outboard position with respect to centerline 48, as described hereinafter, and also to restrain rotational movement of bit 30. This random indexing assures uniform wear of gage buttons 24 over the drilling period.

Figure 2:
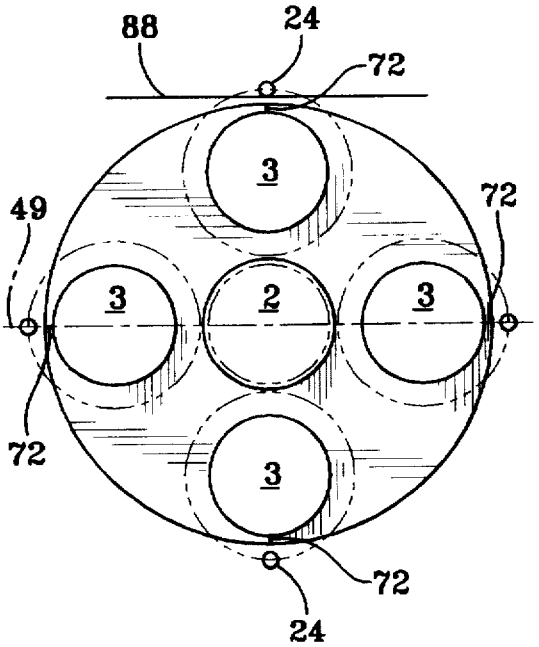
FIG. 2 is a schematic plan view of a bottom end of a cluster drill according to the invention.

When a plurality of individual drills 3 are assembled into a cluster drill 1, in order to maintain maximum borehole diameter it is necessary to assure that, when the bit 30 is in the first stop position, a gage button 24 is positioned out beyond the outer diameter of casing 5 in a maximum outboard position with respect to cluster drill centerline 49, as shown in FIGS. 1 and 2. This is accomplished by first, fixing (with any conventional locking and unlocking keyway arrangement 86) each external drill 3 in a position with respect to casing 5 such that a spline 72 of each chuck 34 is at a tangent line 88 drawn to the outer diameter of casing 5. Second, a gage button 24 is axially aligned below each bit spline 66. At least one gage button 24 should be angularly aligned with respect to the individual drill centerline 48 so as to position at least one gage button 24 per bit spline 66 to assure that when the splines 66, 72 of the bit 30 and chuck 34 engage, a gage button 24 is automatically positioned at the maximum outboard position with respect to the centerline 49 of cluster casing 5. Alternatively, a cluster of two or more gage buttons 24 can be positioned on the periphery 22 of head 9, aligned with each bit spline 66, to assure maximum gage button density at the periphery 22.

The total length of splines 66, 72 and grooves 68, 74 engaged during drilling should be just slightly less than the total amount of drop available to bit 30 between first and second stop positions. I prefer a length differential between splines 66, 72 of ½ inch for a two inch bit drop. This guarantees that the bit 30 will not cycle in and out of spline engagement during drilling, and that the drill will be well into stop action when the bit 30 drops to the point where the splines 66, 72 disengage.

In order to assure that splines 66 and 72 engage each other when bit 30 drops down into the first stop position, I prefer to provide the bottom end of each bit spline 66 with a chamfered surface 90 (FIG. 4) to guide the leading end of each spline 66 into its corresponding groove 74 of chuck 34. Alternatively, the chamfered surface can be provided on the top end of the chuck splines 72.

Having described the invention, what is claimed is:

1. A chuck and drill bit combination for insertion into a front end of a casing member of a percussive, down the hole drill for selectively engaging and disengaging said chuck and drill bit during drilling operations comprising:

(a) a chuck adapted for insertion into said casing member;

(b) a drill bit adapted for insertion into said chuck;

(c) means for retaining said drill bit within said chuck while permitting said bit to move axially between a first and second stop position;

(d) said bit and chuck each having splines and grooves adapted to overlap and engage each other in said first stop position and further adapted to disengage from each other in said second stop position, whereby said bit is restrained from rotational movement but capable of axial movement in said first stop position and capable of both axial and rotational movement in said second stop position;

(e) said bit having a head with an outer periphery containing a plurality of abrasion resistant gage buttons for maintaining maximum borehole diameter;

(f) said chuck and bit combination further comprising:

(g) said chuck having an inner circumferential surface forming a plurality of alternately spaced, axially extending chuck splines and grooves;

(h) said bit having a shank with an outer surface forming a plurality of alternately spaced, axially extending bit splines and grooves, said bit splines and grooves and chuck splines and grooves adapted to overlap and engage each other in said first stop position and further adapted to disengage from each other in said second stop position; and (i) said bit head having an outer periphery containing a plurality of drilling gage buttons, said gage buttons being angularly positioned around a drill centerline with respect to said bit grooves and splines whereby, in said first stop position, at least one gage button is axially aligned with each bit spline.

2. The chuck and drill bit combination of claim 1 further comprising:

(a) said chuck splines and grooves extending an axial length a first distance;

(c) said bit splines and grooves extending an axial length a second distance;

(c) said first stop position positioning said chuck and bit splines and grooves in an overlapping and engaged juxtaposition; and (d) said second stop position positioning said chuck and bit splines and grooves in an axially spaced apart, disengaged juxtaposition.

3. The chuck and drill bit combination of claim 2 further comprising:

(a) said bit comprising:

(i) a shank terminating in its upper end in a retaining shoulder having a first diameter with respect to said drill centerline, said retaining shoulder adapted to contact a split ring in said casing to retain said bit in said chuck providing said first stop position;

(b) an annular undercut groove in said shank outer surface adjacent said retaining shoulder, said undercut groove having a second diameter with respect to said drill centerline, said second diameter being smaller than said first diameter;

(c) a bit drive shoulder adjacent said bit head adapted to be seated against a front end of said chuck, when said bit is in contact with a borehole bottom providing said second stop position; and (d) said annular undercut groove extending an axial distance along said shank to allow axial movement of said bit between said first and second stop positions.

4. The chuck and drill bit combination of claim 3 further comprising:

(a) means on said bit splines for directing said chuck splines and grooves into engaged juxtaposition with said bit splines and grooves, when said bit moves axially from said second stop position to said first stop position.

5. In a cluster drill having an assembly of a plurality of individual percussion drills in a cylindrical casing having a top end connected to a drill string, said casing totally enclosing said percussive drills and means for supplying pressure fluid for each of said drills, the improvement comprising:

(a) a chuck and bit combination for insertion into a front end of a casing member of each individual percussive drill, for selectively engaging and disengaging said drill bit and chuck during drilling operations;

(b) said chuck adapted for insertion into said casing member, said chuck having an inner circumferential surface forming a plurality of alternately spaced, axially extending chuck splines and grooves;

(c) said drill bit adapted for insertion into said chuck;

(d) means for retaining said drill bit within said chuck while permitting said bit to move axially between a first and second stop position;

(e) said bit having a shank with an outer surface forming a plurality of alternately spaced, axially extending bit splines and grooves, said bit splines and grooves and chuck splines and grooves adapted to mate with and engage each other in said first stop position and further adapted to disengage from each other in said second stop position, whereby said bit is restrained from rotational movement but capable of axial movement in said first position and capable of both axial and rotational movement in said second stop position;

(f) said bit having a head with an outer periphery containing a plurality of abrasion resistant buttons, said buttons being angularly positioned with respect to said bit grooves and splines whereby at least one drilling button is positioned diametrically outboard of said cluster drill casing member, in said first stop position, whereby maximum borehole diameter is maintained.

* * * * *